US006354711B1

(12) United States Patent
McCoy

(10) Patent No.: US 6,354,711 B1
(45) Date of Patent: Mar. 12, 2002

(54) GLOWING COASTER

(75) Inventor: Ronald T. McCoy, 211 Betts Rd., Harrisonburg, VA (US) 22802

(73) Assignee: Ronald T. McCoy, Harrisonburg, VA (US)

( * ) Notice: Subject to any disclaimer, the term of this patent is extended or adjusted under 35 U.S.C. 154(b) by 0 days.

(21) Appl. No.: 09/519,186

(22) Filed: Mar. 6, 2000

(51) Int. Cl.[7] ..... F21V 33/00

(52) U.S. Cl. ..... 362/101; 362/154; 362/253; 362/800

(58) Field of Search ..... 362/101, 154, 362/253, 800

(56) References Cited

U.S. PATENT DOCUMENTS

| | | | | | |
|---|---|---|---|---|---|
| 4,336,574 | A | | 6/1982 | Goodman | 362/101 |
| 4,858,084 | A | | 8/1989 | Sheryll | 362/101 |
| 5,010,461 | A | | 4/1991 | Saotome | 362/101 |
| 5,307,250 | A | | 4/1994 | Pearson | 362/101 |
| 5,784,265 | A | | 7/1998 | Chen | 362/101 |
| 5,879,068 | A | | 3/1999 | Menashrov et al. | 362/101 |
| 5,915,832 | A | | 6/1999 | Baird | 362/551 |
| 6,065,848 | A | * | 5/2000 | Tucker et al. | 362/101 |
| 6,152,575 | A | * | 11/2000 | Montanino | 362/154 X |

* cited by examiner

*Primary Examiner*—Stephen Husar

(57) ABSTRACT

A glowing coaster composed of a base, an LED light source installed in the base, an upper assembly consisting of an absorbent pad and housing and a wall transformer power source, which when plugged into a wall receptacle, causes the LED to light and create a glowing effect to the outer surface of a portion of the base or the upper assembly allowing the device to be easily located in a darkened room.

2 Claims, 3 Drawing Sheets

GLOWING COASTER

CROSS REFERENCE TO RELATED APPLICATIONS

Not applicable

BACKGROUND

1. Field of Invention

Figure 1:
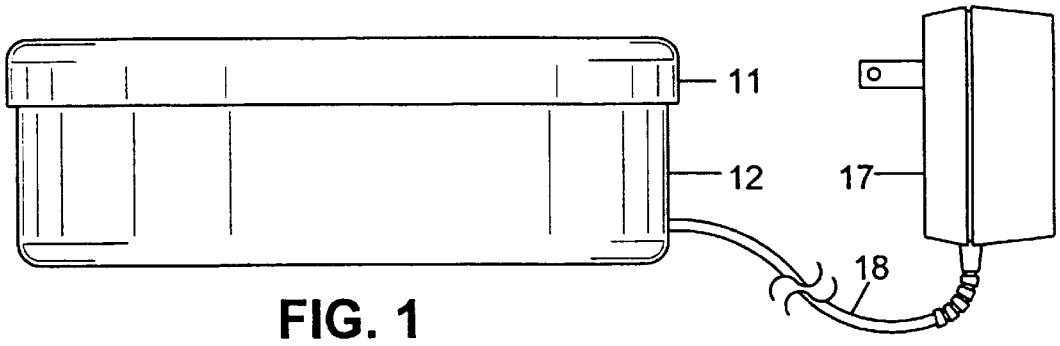

This invention pertains to coasters that glow in a dark room, specifically, a coaster improved by an LED light source and transformer operated power source.

2. Description of Prior Art

The prior art either has a light source internal to the drinking vessel or has a coaster with springs and other moving parts to activate a light source powered by batteries, with the intention of illuminating the drinking vessel via the coaster or directly lighting the drinking vessel.

There have been a number of illuminated drinking vessel patents as shown in U.S. Pat. No. 5,879,068, Menashrov, Mar. 9, 1999, and U.S. Pat. No. 5,624,177 Rosaia, Apr. 29, 1997. These and other internally illuminated vessels do not provide the desired flexibility displayed by the use of a coaster which glows in the dark.

Some illuminated coasters are designed to illuminate when a drinking vessel is nearly empty such as a beer bottle at a bar. U.S. Pat. No. 5,307,250, Pearson, is an example of this of coaster.

There have also been a number of illuminated coasters with pressure sensitive switches requiring a reasonable container weight to effect lighting and are battery powered as evidenced by U.S. Pat. No. 5,784,265, Chen, Jul. 21, 1998.

These and other prior art illuminated coasters engage pressure sensitive switches with moving parts to activate the light source. The problem that may be encountered with moving parts is that sensitivity could change or fail with high usage and abuse but is a necessary part of the prior invention to conserve battery energy.

Another problem with pressure sensitive activated illuminated coasters is that, once the drinking vessel is removed from the coaster, the light goes out, making it very difficult to return the item in the dark to its original location.

SUMMARY OF THE INVENTION

A glowing coaster, having no moving parts, is composed of a wall transformer power supply, opaque or translucent base assembly, LED light circuit, translucent top and absorbent pad.

OBJECTS AND ADVANTAGES

It is the intended that my glowing coaster to proffer a device that has no moving parts in order to reduce production expense and improve reliability.

It is further intended that the coaster be continuously illuminated in a glowing fashion for the purpose of establishing the location of the device in the dark, and hence the object located thereon.

It is also intended that the light produced by the coaster be sufficiently subdued as to not pose a disturbance to a person sensitive to sleeping without appreciable light in the room.

An additional object is to energize the device with a low power wall transformer to provide continuous power to an LED, so as to eliminate the use of batteries as the power source.

It is a further object of my coaster to reduce the heat energy dissipated within the coaster housing or surface through the use of an LED light source and a remote power supply.

The lack of any moving parts also makes my coaster far more attractive to purchase and operate.

With the continuous glow provided by my coaster, articles such as a glasses of liquid, eye glasses, medicine, etc. can easily by retrieved and returned without fumbling in the dark.

Negligible heat is generated from the light source; therefore, ice water in an insulated glass could be placed on the coaster and stay cool for hours.

BRIEF DESCRIPTION OF DRAWING FIGURES

The accompanying drawings illustrate the invention. In such drawings:

FIG. 1: is a side orthogonal view of an illuminated coaster with a base.

Figure 2:
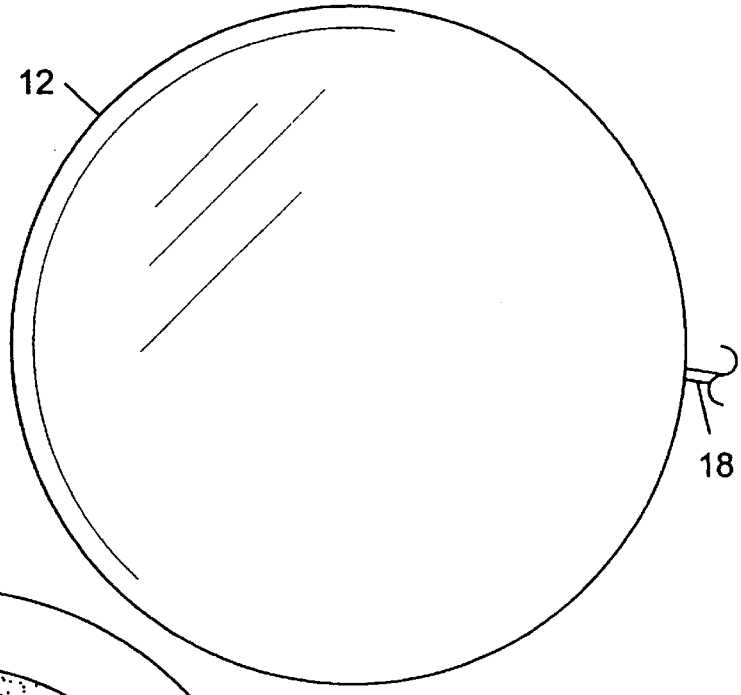

FIG. 2: is a bottom orthogonal view of the base.

Figure 3:
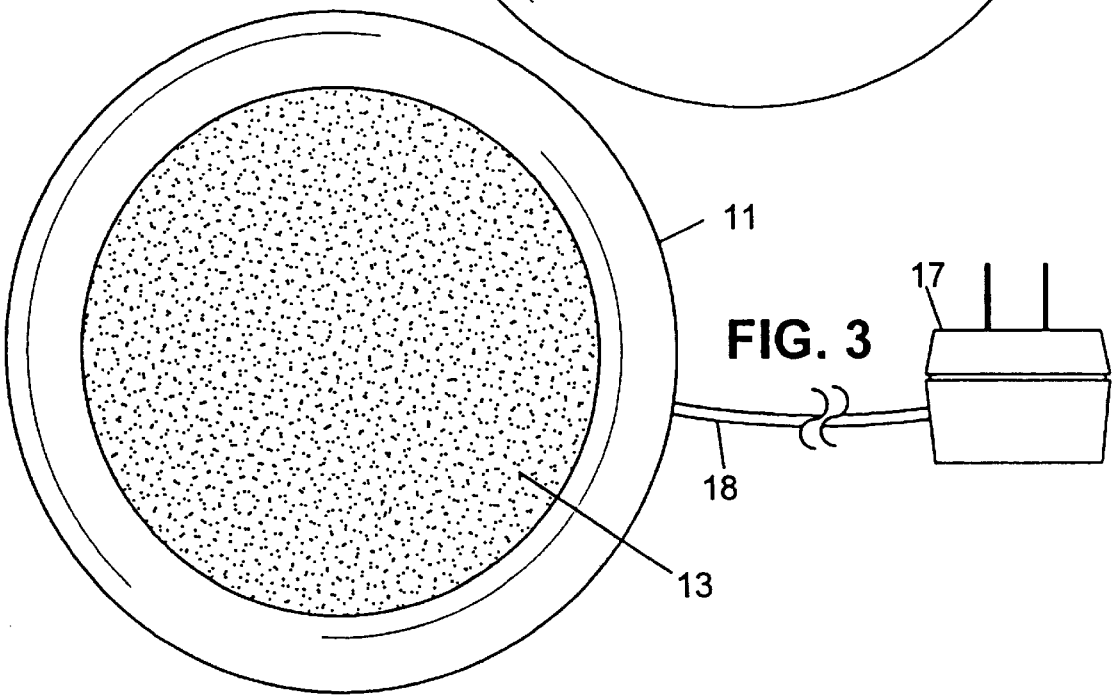

FIG. 3: is a top orthogonal view of the coaster and an absorbent material insert.

Figure 4:
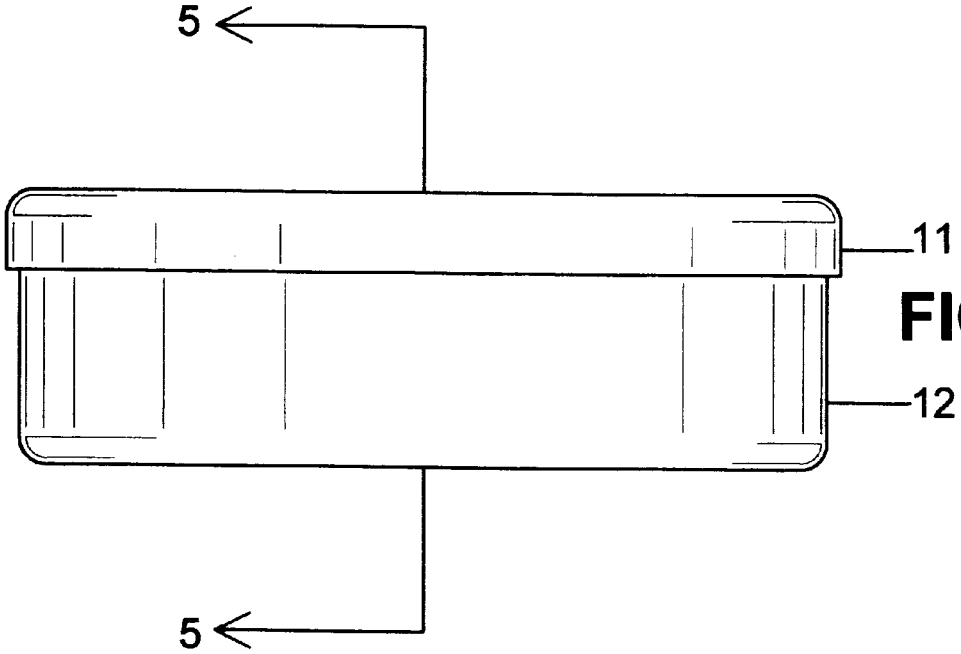

FIG. 4: is a general side view of the coaster with a sectional plane.

Figure 5:
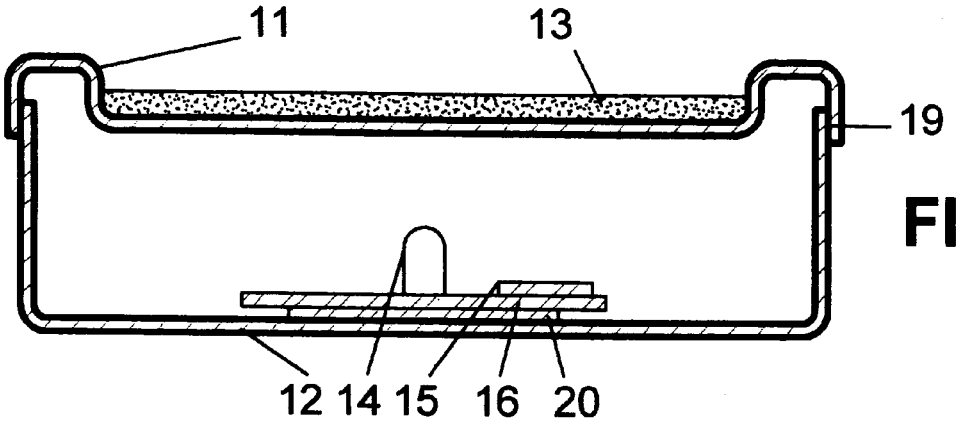

FIG. 5: is a perspective sectional view of the coaster showing the internal parts.

Figure 6:
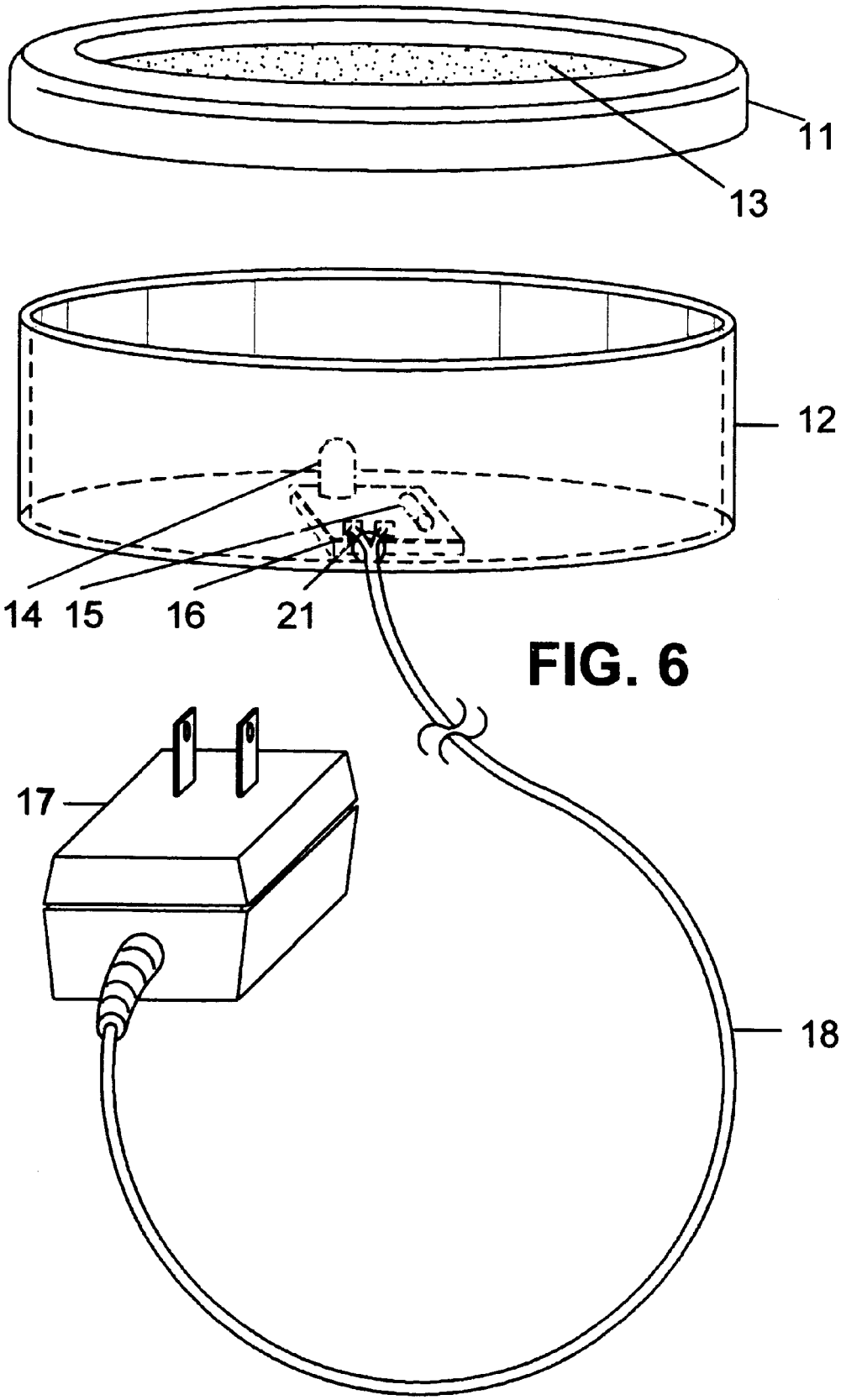

FIG. 6: is an isometric view (from above) of the coaster showing the internal parts with hidden lines.

REFERENCE NUMBERS IN DRAWINGS

11 surface assembly
12 base assembly
13 absorbent material
14 light emitting diode (LED)
15 resistor
16 circuit board
17 transformer/A C adapter
18 wire
19 glue joint
20 double stick tape or other adhesive
21 circuit

DETAILED DESCRIPTION OF PREFERRED EMBODIMENT

Referring now to the drawing figures and reference numbers, preferred glowing coaster in accordance with the present invention is designated as FIG. 1. An LED 14 is connected to resistor 15 to form an electrical circuit 21. A wire 18 is connected from Circuit 21 through base 12 to transformer 17 and circuit board 16 is mounted to the center of base 12. Surface assembly 11 is attached to base assembly 12 with glue 19. Absorbent pad 13 is glued to surface assembly 11. The assembled items form a completed glowing coaster FIG. 1.

OPERATION—FIGS. 1,2,3,4,5,6

No assembly required. Simply remove the completed product from its package and place the coaster on any horizontal flat surface. Then plug the transformer into any standard 110–115 volt wall receptacle. The coaster is designed to glow 24 hours a day. Almost any 16 ounce drinking vessel, medicine bottles, eye glasses, etc. may be placed on the coaster to be retrieved and returned safely in the dark.

CONCUSION, RAMIFICATIONS, AND SCOPE

My glowing coaster is a device that has no moving parts in order to reduce production expense and improve reliability.

It is further intended that the coaster be continuously illuminated in a glowing fashion for the purpose of establishing the location of the device in the dark, and hence the object located thereon.

It is also intended that the light produced by the coaster be sufficiently subdued as to not pose a disturbance to a person sensitive to sleeping without appreciable light in the room.

An additional object is to energize the device with a low power wall transformer to provide continuous power to an LED, so as to eliminate the use of batteries as the power source.

It is a further object of my coaster to reduce the heat energy dissipated within the coaster housing or surface through the use of an LED light source and a remote power supply.

The lack of any moving parts also makes my coaster far more attractive to purchase and operate.

With the continuous glow provided by my coaster, articles such as a glass of liquid, eye glasses, medicine, etc. can easily by retrieved and returned without fumbling in the dark.

Even with the continuous glow the power to the light source will cost less than a penny a day to operate.

Negligible heat is generated from the light source; therefore, ice water in an insulated glass could be placed on the coaster and stay cool for hours.

What is claimed is:

1. An illuminated coaster comprising: a housing made of translucent or opaque plastic having a base assembly, a light emitting diode installed on and inside the base assembly and connected by an electrical cord to a remote transformer power supply, said housing being enclosed by a top cover assembly made of translucent plastic and having an absorbent pad attached to the outer surface of the top cover assembly.

2. The illuminated coaster as set forth in claim 1 wherein said housing may be of any color or density.

* * * * *